US007279045B2

(12) United States Patent
Strebe

(10) Patent No.: US 7,279,045 B2
(45) Date of Patent: Oct. 9, 2007

(54) APPARATUS FOR WETTING A RUNNING FILAMENT STRAND

(75) Inventor: Matthias Strebe, Neumünster (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 11/406,146

(22) Filed: Apr. 18, 2006

(65) Prior Publication Data

US 2006/0188594 A1 Aug. 24, 2006

Related U.S. Application Data

(60) Division of application No. 10/912,634, filed on Aug. 5, 2004, now Pat. No. 7,157,122, which is a continuation of application No. PCT/EP03/00941, filed on Jan. 30, 2003.

(30) Foreign Application Priority Data

Feb. 7, 2002 (DE) ..... 102 05 005

(51) Int. Cl.
*B05C 5/00* (2006.01)
*B05B 15/04* (2006.01)
*B05B 1/28* (2006.01)

(52) U.S. Cl. ..... 118/325; 118/301; 118/326; 118/313; 118/504; 118/501

(58) Field of Classification Search ..... 118/325, 118/326, 504, 505, 501, 300–301, 313–316; 28/167, 254, 104, 178; 68/5 D, 5 E; 8/149.1, 8/149.2, 149.3, 151–151.2; 427/424, 282, 427/421.1

See application file for complete search history.

(56) References Cited

U.S. PATENT DOCUMENTS

| | | | | |
|---|---|---|---|---|
| 2,425,214 | A | 8/1947 | Voelker et al. | |
| 3,318,281 | A | 5/1967 | Plegat | |
| 3,605,682 | A * | 9/1971 | Groce et al. | 118/694 |
| 3,906,893 | A * | 9/1975 | Scales | 118/63 |
| 4,068,615 | A | 1/1978 | LeNir | |
| 4,608,398 | A * | 8/1986 | Cobbs et al. | 521/113 |
| 4,653,387 | A * | 3/1987 | Osawa et al. | 454/51 |
| 4,783,977 | A | 11/1988 | Gilpatrick | |
| 4,891,249 | A * | 1/1990 | McIntyre | 427/208.6 |
| 5,020,472 | A * | 6/1991 | Kiba et al. | 118/668 |
| 5,536,315 | A * | 7/1996 | Guzowski et al. | 118/301 |
| 5,670,202 | A | 9/1997 | Guzowski et al. | |
| 5,855,509 | A * | 1/1999 | White et al. | 454/52 |
| 6,066,361 | A | 5/2000 | Jacobsen et al. | |
| 6,266,835 | B1 | 7/2001 | Henry et al. | |
| 2002/0100415 | A1 * | 8/2002 | Molnar et al. | 118/313 |

FOREIGN PATENT DOCUMENTS

| | | |
|---|---|---|
| EP | 0 344 649 A2 | 12/1989 |
| EP | 0 965 673 A1 | 12/1999 |
| FR | 2 479 290 A1 | 10/1981 |

* cited by examiner

*Primary Examiner*—Yewebdar Tadesse
(74) *Attorney, Agent, or Firm*—Alston & Bird LLP

(57) ABSTRACT

An apparatus for wetting an advancing filament bundle. A fluid is applied by means of a nozzle in the form of a fluid spray jet to the filament bundle advancing in spaced relationship with the nozzle. A portion of the spray jet is shielded before impacting upon the filament bundle, so that the application of fluid to the filament bundle is determined by the degree of shielding of the spray jet. With that, the invention is adapted for finely adjusting the fluid application to the filament bundle.

12 Claims, 2 Drawing Sheets

APPARATUS FOR WETTING A RUNNING FILAMENT STRAND

CROSS REFERENCE TO RELATED APPLICATION

The present application is a division of U.S. application Ser. No. 10/912,634 filed Aug. 5, 2004 now U.S. Pat. No. 7,157,122, which in turn is a continuation of international application PCT/EP2003/000941, filed 30 Jan. 2003, and which designates the U.S. The disclosures of the referenced applications are incorporated herein by reference.

BACKGROUND OF THE INVENTION

The present invention relates to an apparatus for wetting an advancing filament bundle which is capable of closely controlling the amount of the fluid applied to the bundle.

In the production of synthetic multifilament yarns or synthetic multifilament tows, it is known to apply a fluid to the filament bundle forming the yarn or tow for purposes of forming a yarn coherence, or enabling further processing, or effecting a cooling. In this process, the fluid may be applied by a nozzle, which generates a spray jet that is directed toward the filament bundle, as is disclosed, for example, in EP 0 344 649. Methods and apparatus of this type have been found satisfactory in particular for a continuous wetting of a filament bundle.

To wet a filament bundle at a varied speed of advance with different applications of fluid, nozzles of the described type are however suited only to a limited extent. For example, a reduction of the fluid quantity that is sprayed on by the nozzle, directly leads to a change in the spray pattern or spray angle. Thus, it is possible only to a limited extent to influence the fluid application to the filament bundle by controlling the nozzle. The known method and the known device are unable to perform a fine adjustment of the fluid applications to the filament bundle.

It is therefore an object of the invention to further develop an apparatus for wetting an advancing filament bundle in such a manner that the filament bundle is able to receive at a speed of advance an adjustable and substantially constant application of fluid.

SUMMARY OF THE INVENTION

The above and other objects and advantages are achieved by the present invention which has the advantage that regardless of the respectively desired fluid application to the filament bundle, it is always possible to operate the nozzle in an optimal work range with a constantly delivered quantity of fluid. The spray jet generated by the nozzle is constant in its dimensions. To adjust the fluid application, the invention provides for shielding a portion of the spray jet before impacting upon the filament bundle, so that only the unshielded portion of the spray jet is effective for wetting the filament bundle. The application of fluid to the filament bundle is thus defined by the degree of shielding of the spray jet. A high degree of shielding of the spray jet effects a relatively small fluid application, and a small degree of shielding a large fluid application to the filament bundle.

To wet the filament bundle with a constant and uniform application of fluid even at a varied speed of advance, an advantageous further development of the invention provides for varying the degree of the shielding of the spray jet. With that, it is possible to adapt the application of fluid always to the process or process changes.

In this connection, it is especially advantageous to adapt the application of fluid constantly to the speed of advance of the filament bundle. To produce a constant application of fluid to the filament bundle, the degree of shielding is lessened, when increasing the speed of advance of the filament bundle, in such a manner that the portion of the spray jet impacting upon the filament bundle becomes greater and, thus, the fluid application remains constant even at a higher speed of advance.

To vary the degree of the shielding of the spray jet, it is possible to make either the shielding means arranged between the nozzle and the filament bundle movable, or to construct the nozzle for movement, so that the shielding means covers a more or less defined portion of the spray jet.

Since in the case of relatively small fluid applications to the filament bundle, a considerable portion of the spray jet is not used for wetting the filament bundle, it is preferred to use the further development of the invention, wherein the fluid of the shielded portion of the spray jet is collected, drained, and delivered into a tank. To this extent, it is advantageous to construct the shielding means as a drip plate, with the collected fluid being discharged via a drain into the spray box.

The collection and discharge of the unused fluid enables another, especially preferred further development of the invention, wherein the drained fluid is measured to determine an actual quantity of the fluid application directly from the difference between the quantity of fluid delivered through the nozzle and the drained quantity of fluid. With that, it is possible to determine the actual application of fluid to the filament bundle.

To this end, the device of the invention comprises a measuring unit, which is used to determine on the one hand the quantity of fluid that is returned via a return flow line into the tank, and on the other hand the quantity of fluid that is delivered from the source of fluid to the nozzle. The measuring unit connects to a control unit, in which the actual fluid application can be computed by subtraction.

To obtain a constant application of fluid at any time irrespective of the speed of advance of the advancing filament bundle, an especially preferred further development of the invention provides for adjusting the degree of shielding as a function of a comparison between actual and desired values of the fluid application. To this end, a defined signal is generated within the control unit as a function of the comparison between actual and desired quantities. This signal is used to control the movement of the shielding means or the actuator that performs the movement of the nozzle.

To obtain a uniform wetting even in the case of very thick filament bundles, which are produced, for example, in the production of tows, it is advantageous to operate the device of the invention with two nozzles inside the spray box, with a shielding means being associated to each of the oppositely arranged nozzles. With that, the filament bundle is simultaneously wetted from an upper side and an underside.

BRIEF DESCRIPTION OF THE DRAWINGS

In the following, the method and apparatus of the invention are described in greater detail by means of some embodiments of the device according to the invention with reference to the attached Figures, in which.

DETAILED DESCRIPTION OF THE PREFERRED EMBODIMENTS

Figure 1:
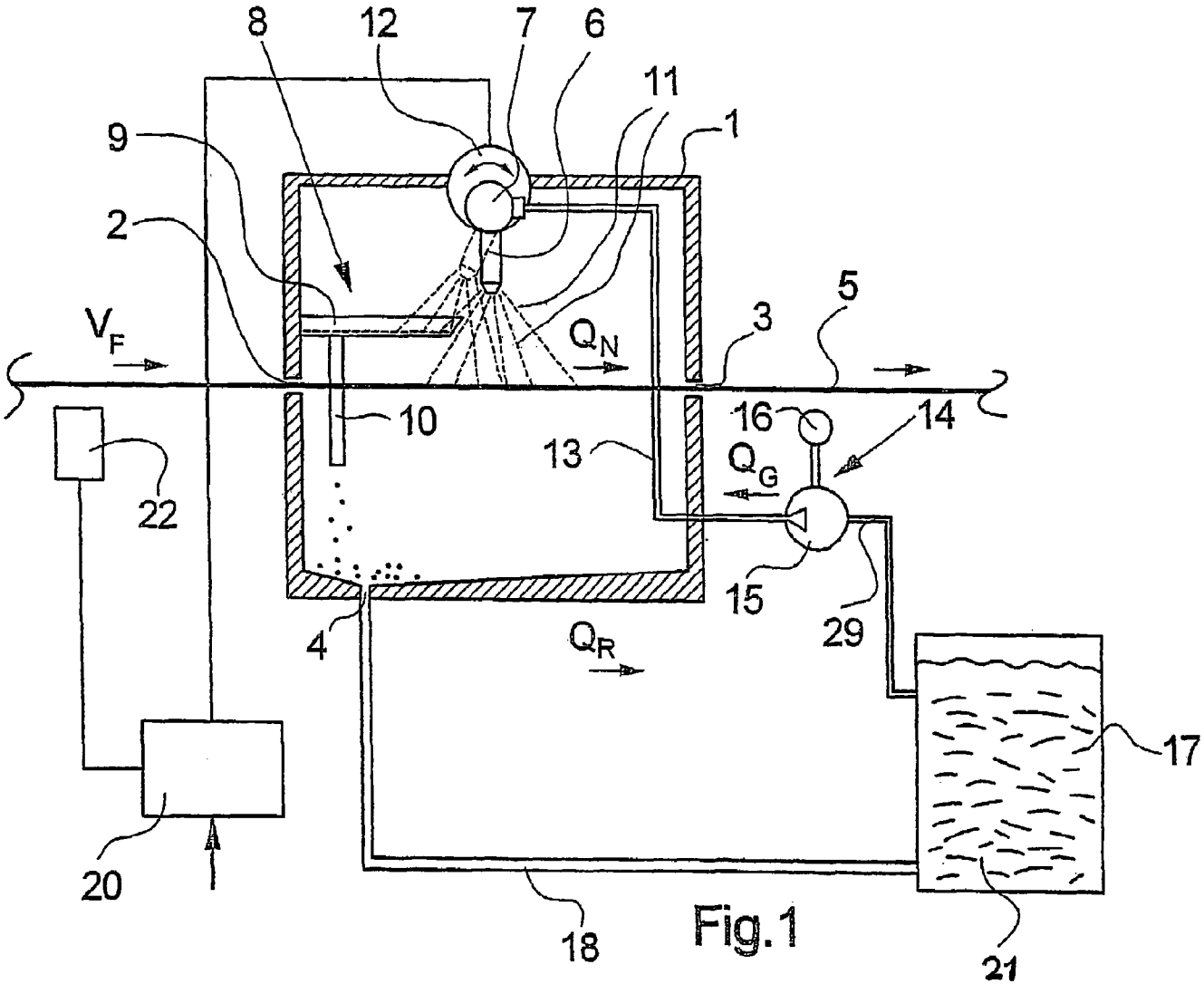
FIG. 1 is a schematic view of a first embodiment of the device according to the invention.

FIG. 1 schematically illustrates a first embodiment of the device according to the invention, which can be used for carrying out the method of wetting a filament bundle in accordance with the invention. The device comprises a spray box 1. The spray box 1 has on its one side an inlet 2 and on its opposite side an outlet 3, through which a filament bundle 5 advances. In so doing, the filament bundle 5 advances through the spray box 1 along a guide path that is defined by the inlet 2 and the outlet 3.

Inside the spray box 1, a nozzle 6 is arranged in spaced relationship with the guide path defined by the filament bundle 5. To this end, the nozzle 6 is mounted to a support 7 inside the spray box 1 in such a manner that a spray jet 11 generated by the nozzle 6 can be produced in the direction of the filament bundle 5. The nozzle 6 is constructed for pivotal movement on the support 7. The pivotal movement of the nozzle 6 is performed by an actuator 12 that is constructed as a pivot drive. The pivot drive 12 connects to a control unit 20.

Via a supply line 13, the nozzle 6 connects to a source of fluid 14. The source of fluid 14 is formed by a pump 15 and a motor 16 that drives the pump 15. The pump 15 connects via a suction line 29 to a tank 17. The tank 17 holds a fluid 21.

Inside the spray box 1 a shielding means 8 is arranged between the filament bundle 5 and the nozzle 6. The shielding means 8 is constructed as a drip plate 9, which is rigidly connected to the spray box 1. In this arrangement, the drip plate 9 totally covers the filament bundle 5 in the region of the spray jet 11. Depending on the position of the nozzle 6, only a portion of the spray jet 11 is collected by the drip plate 9. The drip plate 9 has a drain 10, which guides the collected fluid within the spray box 1 to a discharge opening 4. Connected to the discharge opening 4 in the bottom region of the spray box 1 is a return flow line 18, which connects the spray box 1 with the tank 17.

The control unit 20 is coupled with a sensor 22, which signals the momentary speed of advance of the filament bundle 5 to the control unit 20.

In the embodiment shown in FIG. 1, the filament bundle 5 advances at a speed $v_F$ through the spray box 1 via the inlet 2 and the outlet 3. Inside the spray box 1, the nozzle 6 produces a spray jet 11. To this end, the pump 15 takes in a fluid 21 from the tank 17 and supplies it under pressure via the supply line 13 to the nozzle 6. In the position of the nozzle 6 shown in FIG. 1, a portion of the spray jet 11 shielded and collected by the drip plate 9 before impacting upon the filament bundle 5. The portion of the spray jet 11 that is not shielded by the drip plate 9 reaches unimpeded the filament bundle 5, and leads to a wetting of the filament bundle 5. The fluid that has been shielded and collected by the drip plate 9, is guided via the drain 10 to the discharge opening 4 formed in the bottom region of the spray box 1. As a whole, fluid that is not used in the spray box 1 for wetting the filament bundle 5 is supplied, via the return flow line 18 to the tank 17. The quantity of the fluid that determines the fluid application to the filament bundle 5, is indicated in FIG. 1 at $Q_N$. $Q_N$ thus represents the usable fluid quantity that forms the application of fluid to the filament bundle 5. The usable fluid quantity $Q_N$ results from the difference between the total quantity of fluid $Q_G$, which is supplied by means of pump 15 to the nozzle 6, and the discharged fluid $Q_R$ that is delivered via the return flow line 18 to the tank 17.

In the case that the speed of advance $v_F$ of the filament bundle slows down, a corresponding signal is supplied via the sensor 22 to the control unit 20. The control unit 20 will then transmit a control signal to the pivot drive 12, so that the nozzle 6 is pivoted by the pivot drive in the direction of the drip plate 9. This situation is shown in phantom lines in FIG. 1. With that, the drip plate 9 increases the degree of shielding of the spray jet 11. The portion of the spray jet 11 that is delivered unimpeded for wetting the filament bundle 5 becomes smaller, so that as a whole a substantially constant application of fluid to the filament bundle 5 is realized. The nozzle 6 and the pump 15 advantageously operate always with a constant adjustment in an optimal operating point. Despite the variable speed of advance of the filament bundle 5, it thus possible to produce with advantage a constant application of fluid.

Figure 2:
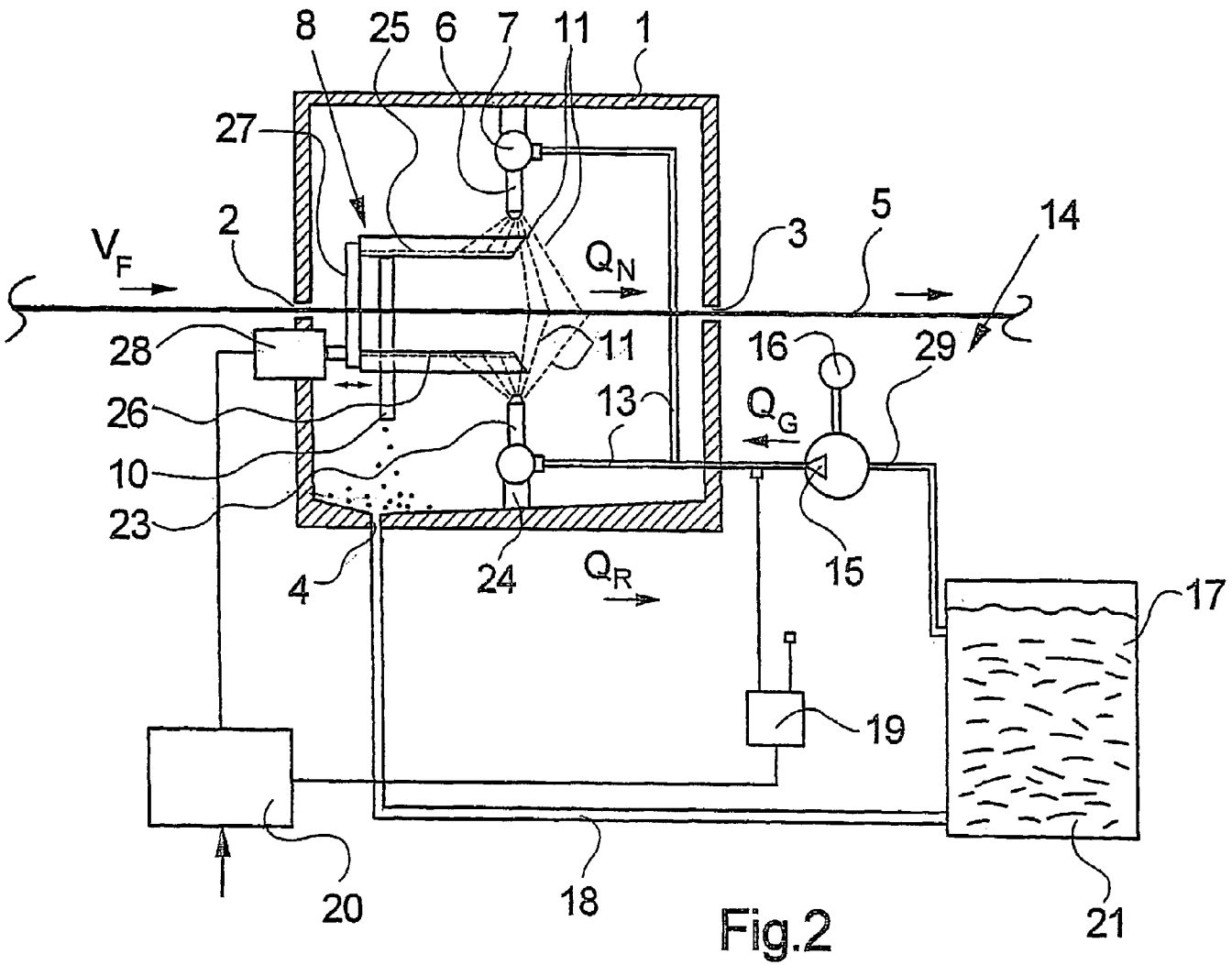
FIG. 2 is a schematic view of a further embodiment of the device according to the invention.

FIG. 2 schematically illustrates a further embodiment of the device according to the invention. The components of same function have been provided with identical reference numerals.

The embodiment of FIG. 2 also comprises a spray box 1, which is the same as in the foregoing embodiment. Inside the spray box 1, a first nozzle 6 is arranged above the guide path defined by the filament bundle 5, and a second nozzle 23 below the guide path. The nozzles 6 and 23 connect via a supply line 13 to the source of fluid 14. The source of fluid 14 is likewise constructed in the same way as in the foregoing embodiment. The nozzles 6 and 23 are each mounted on a support 7 and 24 inside the spray box 1. As a shielding means 8, an upper drip plate 25 is associated to the first nozzle 6, and a lower drip plate 26 to the second nozzle 23. The upper drip plate 25 and the lower drip plate 26 cover the filament bundle 5 advancing between the two drip plates 25 and 26. The drip plates 25 and 26 are mounted to a holder 27. The holder 27 is made adjustable from side to side. To this end, the holder 27 connects to an actuator 28 in the form of an actuation drive. The actuation drive 28 connects via a control line to the control unit 20.

The fluid that is shielded and collected by the drip plates 25 and 26 is guided via its respective drain 10 to the discharge opening 4 of the spray box 1, with the discharge opening 4 connecting via the return flow line 18 to the tank 17.

Outside the spray box 1, a measuring unit 19 is provided, which connects on the one hand to the supply line 13 of the pump 15, and on the other hand to the return flow line 18. With the use of flow sensors, the measuring unit 19 determines the fluid quantities in the supply line 13 and the return flow line 18. The measuring unit 19 connects to the control unit 20.

In the device shown in FIG. 2, the filament bundle 5 is simultaneously wetted from two sides by the nozzles 6 and 23. In this process the spray jet 11 generated by the nozzle 6 is partially shielded by the upper drip plate 25. The lower drip plate 26 leads to a corresponding shielding of the second nozzle 23. In the present embodiment, the degree of the shielding is the same for each of the nozzles 6 and 23, so that the fluid application is evenly distributed on both sides of the filament bundle.

To determine the fluid application to the filament bundle 5, the total fluid quantity $Q_G$ delivered by the pump 15 is determined by the measuring unit 19. Likewise, the fluid quantity $Q_R$ that is discharged through the return flow line 18 into the tank 17 is measured. From the two measured values, it is possible to compute by subtraction the usable fluid quantity $Q_N$ that defines the fluid application. Accordingly, $Q_N = Q_G - Q_R$.

In the control unit 20, the actual and desired values of the computed usable fluid quantity $Q_N$ are compared. In the case of a deviation, the control unit 20 generates a control signal and supplies it to the actuator 28. The actuator 28 performs a corresponding position change of the holder 27 and thus changes the position of the upper drip plate 25 and the lower drip plate 26. Thus, the degree of overlap of the spray jet 11 will increase, for example, when a predetermined desired value of the usable fluid quantity $Q_N$ is exceeded. With that, less fluid would reach the filament bundle 5. In the case that the desired value is not reached, the degree of overlap of the spray jet 11 is reduced, so that the holder 27 is moved by the actuation drive 28 in the direction of the inlet 2. It is thus possible to produce a uniform and constant fluid application irrespective of the state and the advance of the filament bundle 5. The nozzles 6 and 23 operate in this process under constant conditions. The spray pattern of the spray jet 11 that is generated by the nozzles 6 and 23, is preferably rectangular.

Both the method and the apparatus of the invention are suitable for applying to the filament bundle for its lubrication, for example, a yarn lubricant, which may consist, for example, of an oil-water emulsion. However, it is also possible to apply to the filament bundle any desired fluids, such as, for example, pure water for cooling or conditioning. The method and the device of the invention can be used regardless of whether the filament bundle is a single synthetic yarn or a tow formed by a yarn bundle.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for wetting an advancing filament bundle, comprising a spray box which includes an inlet and an outlet for guiding the advance of a filament bundle therethrough, a nozzle mounted within the spray box in spaced relation to the advancing filament bundle, with the nozzle being connected to a source of fluid and located to direct a fluid spray jet toward the filament bundle, a shielding member arranged in the spray box between the nozzle and the advancing filament bundle, such that the fluid spray jet produced by the nozzle is partially shielded and impacts only in part upon the filament bundle, an actuator for performing a movement of the shielding member relative to the nozzle, or for performing a movement of the nozzle relative to the shielding member, and a control unit connected to the actuator for controlling the movement performed by the actuator and thus controlling the amount of the fluid applied to the filament bundle, and a sensor for sensing the speed of advance of the filament bundle, with said sensor being coupled to the control unit, and with said control unit being configured to signal the actuator as a function of the sensed speed so that the actuator maintains a substantially constant application of fluid to the filament bundle at varying speeds.

2. The apparatus of claim 1, wherein the shielding member is made movable for varying the degree of shielding of the fluid spray jet.

3. The apparatus of claim 1, wherein the nozzle is made movable for varying the degree of shielding of the fluid spray jet.

4. The apparatus of claim 1, wherein the shielding member is formed by a drip plate, which includes a drain for discharging the collected fluid.

5. The apparatus of claim 1, wherein the spray box connects via a return flow line to a tank, and a measuring unit is provided for determining the fluid quantity that is returned to the tank through the return flow line.

6. The apparatus of claim 5, wherein the measuring unit connects to the source of fluid for determining the quantity of fluid that is delivered by the nozzle.

7. The apparatus of claim 6, wherein the measuring unit is operatively coupled to the control unit, wherein the control unit is configured to calculate the difference between the fluid quantity that is delivered to the nozzle and the fluid quantity that is returned to the tank, and wherein the control unit is coupled to the actuator so as to move the actuator as a function of said difference and thereby achieve a uniform and constant fluid application.

8. The apparatus of claim 1, further comprising a second nozzle arranged inside the spray box in facing relationship with the first nozzle, and wherein a drip plate is associated to each nozzle.

9. The apparatus of claim 1, wherein the source of fluid comprises a tank, and further comprising a pump for delivering a constant supply of the fluid from the tank to the nozzle so that the fluid spray jet of the nozzle operates under constant conditions.

10. An apparatus for wetting an advancing filament bundle, comprising a spray box which includes an inlet and an outlet for guiding the advance of a filament bundle therethrough, a nozzle mounted within the spray box in spaced relation to the advancing filament bundle, with the nozzle being connected to a source of fluid and located to direct a fluid spray jet toward the filament bundle, a shielding member arranged in the spray box between the nozzle and the advancing filament bundle, such that the fluid spray jet produced by the nozzle is partially shielded and impacts only in part upon the filament bundle, and an actuator for performing a movement of the shielding member relative to the nozzle, or for performing a movement of the nozzle relative to the shielding member, and a control unit connected to the actuator for controlling the movement performed by the actuator and thus controlling the amount of the fluid applied to the filament bundle, and wherein the spray box connects via a return flow line to a tank, and a measuring unit is provided for determining the fluid quantity that is returned to the tank through the return flow line.

11. The apparatus of claim 10, wherein the measuring unit connects to the source of fluid for determining the quantity of fluid that is delivered by the nozzle.

12. The apparatus of claim 11, wherein the measuring unit is operatively coupled to the control unit, wherein the control unit is configured to calculate the difference between the fluid quantity that is delivered to the nozzle and the fluid quantity that is returned to the tank, and wherein the control unit is coupled to the actuator so as to move the actuator as a function of said difference and thereby achieve a uniform and constant fluid application.

* * * * *